US012757965B2

(12) United States Patent
Ford et al.

(10) Patent No.: US 12,757,965 B2
(45) Date of Patent: Oct. 13, 2026

(54) HAT INSERT DEVICE

(71) Applicants: Jacob Ford, Tampa, FL (US); Blake Pearson, Tampa, FL (US)

(72) Inventors: Jacob Ford, Tampa, FL (US); Blake Pearson, Tampa, FL (US)

(73) Assignee: Cap Trick LLC, Apollo Beach, FL (US)

( * ) Notice: Subject to any disclaimer, the term of this patent is extended or adjusted under 35 U.S.C. 154(b) by 0 days.

(21) Appl. No.: 18/138,557

(22) Filed: Apr. 24, 2023

(65) Prior Publication Data

US 2024/0349839 A1 Oct. 24, 2024

(51) Int. Cl.
*A42C 5/02* (2006.01)

(52) U.S. Cl.
CPC ..... *A42C 5/02* (2013.01)

(58) Field of Classification Search
CPC ..... A42C 5/00; A42C 5/02; A42C 5/04
See application file for complete search history.

(56) References Cited

U.S. PATENT DOCUMENTS 2,628,361 A * 2/1953 Heyck ..... A42C 5/02 D2/894
3,685,055 A * 8/1972 Militello ..... A42B 3/14 2/416
4,011,600 A * 3/1977 Malk ..... A42B 1/22 2/183
4,406,021 A * 9/1983 Bloom ..... A42C 5/02 2/181
4,484,363 A * 11/1984 Varanese ..... A42C 5/04 2/181.6
4,776,042 A * 10/1988 Hanson ..... A42B 1/008 2/909
RE33,430 E * 11/1990 Nunnery ..... A42B 3/10 2/181.6
5,025,504 A * 6/1991 Benston ..... A42C 5/02 2/181.8

(Continued)

FOREIGN PATENT DOCUMENTS

GB 250418 A * 4/1926
GB 2341784 A * 3/2000 ..... A42B 3/28

OTHER PUBLICATIONS

NoSweat® Official Store | Performance Hat and Helmet liners; https://nosweatco.com/; accessed from Interenet Oct. 18, 2023 (5 pages).

(Continued)

*Primary Examiner* — Megan E Lynch
(74) *Attorney, Agent, or Firm* — Jason T. Daniel, Esq.; Daniel Law Offices, P.A.

(57) ABSTRACT

An insert device for a hat includes an elongated main body that is constructed from a malleable and waterproof material. A lip extends upward from the main body and includes grippers for engaging the inside panel of a hat. The lip folds independently to the main body. A liner is provided along the back surface of the main body. The liner is constructed from a moisture wicking material and functions to draw sweat from the forehead of a user wearing the hat. A foam insert is positioned between the liner and the main body. The insert is provided in different widths to allow the spacing between the liner and the user to be adjustable.

16 Claims, 4 Drawing Sheets

(56) References Cited

U.S. PATENT DOCUMENTS

| | | | | | |
|---|---|---|---|---|---|
| 5,313,668 | A * | 5/1994 | Bogan | A42C 5/02 | 2/209.13 |
| 5,327,585 | A * | 7/1994 | Karlan | A42C 5/04 | 2/209.13 |
| 5,566,395 | A * | 10/1996 | Nebeker | A42C 5/02 | 2/418 |
| 5,613,248 | A * | 3/1997 | Young | A42C 5/02 | 2/209.13 |
| 5,978,969 | A * | 11/1999 | Vinding Diers | A42C 5/02 | 2/DIG. 11 |
| 8,112,821 | B1 * | 2/2012 | Barry | A42C 5/02 | 2/181 |
| 2002/0100107 | A1 * | 8/2002 | Shin | B32B 27/12 | 2/181 |
| 2005/0028246 | A1 * | 2/2005 | Lee | D03D 3/02 | 2/183 |
| 2005/0160519 | A1 * | 7/2005 | Cho | A42B 1/22 | 2/181 |
| 2007/0245457 | A1 * | 10/2007 | Gelera | A42C 5/02 | 2/181 |
| 2010/0132094 | A1 * | 6/2010 | Mullen | A42C 5/02 | 2/209.13 |

OTHER PUBLICATIONS

Stankeez; https://www.stankeez.com/about; accessed from Internet Oct. 18, 2023 (5 pages).

* cited by examiner

HAT INSERT DEVICE

TECHNICAL FIELD

The present invention relates generally to headwear, and more particularly to an insert for hats that are designed to protect the hat from damage caused by sweat, and to increase the comfort and usability of the hat itself.

BACKGROUND

The statements in this section merely provide background information related to the present disclosure and may not constitute prior art.

Various types of hats such as baseball hats, cowboy hats and dress hats are commonly worn by people for a variety of reasons, such as sun protection, fashion or to support a favorite sporting team, for example. Regardless of the reason, hats are a common accessory worn each and every day by millions of people across the globe.

The cost of hats can vary wildly from a few dollars to several hundred dollars, depending on the type, make or style of the hat. Moreover, some users have favorite hats whose monetary value is less important than sentimentality. For these reasons and more, many users seek to preserve their hats so as to prevent damage to the same. As is known, sweat from a user's head is by far the number one way most hats become damaged and/or ruined. In most instances, sweat from the user's forehead seeps through the front panel of the hat so as to create a visible sweat line at a location just above the hat's visor. Unfortunately, when this occurs, it is difficult to remove the damage and often the hat must be thrown out.

Accordingly, it would be beneficial to provide a hat insert device that can be used in conjunction with any type of hat so as to overcome the drawbacks noted above.

SUMMARY OF THE INVENTION

The present invention is directed to an insert device for a hat. One embodiment of the present invention can include an elongated main body that is constructed from a malleable and waterproof material. A lip can extend upward from the main body and can include grippers for engaging the inside panel of a hat. The lip can be permanently or removably connected to the main body and can fold independently to the main body.

In one embodiment, a liner can be provided along the back surface of the main body. The liner can be constructed from a moisture wicking material and can function to draw sweat from the forehead of a user wearing the hat. The liner can be removably or permanently connected to the main body, and an optional foam insert can be positioned between the liner and the main body. The insert can be provided in different widths to allow the spacing between the liner and the user to be adjustable.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
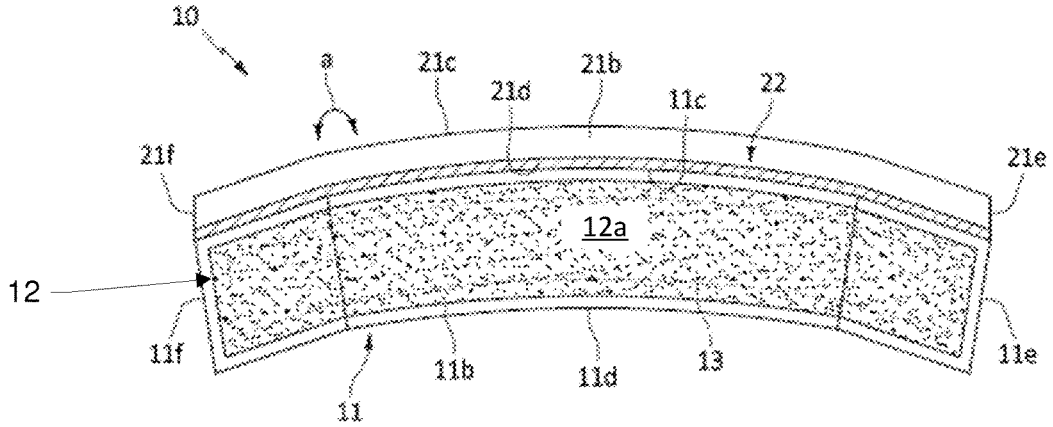
FIG. 1 is a back view of a hat insert device that is useful for understanding the inventive concepts disclosed herein.
Figure 2:
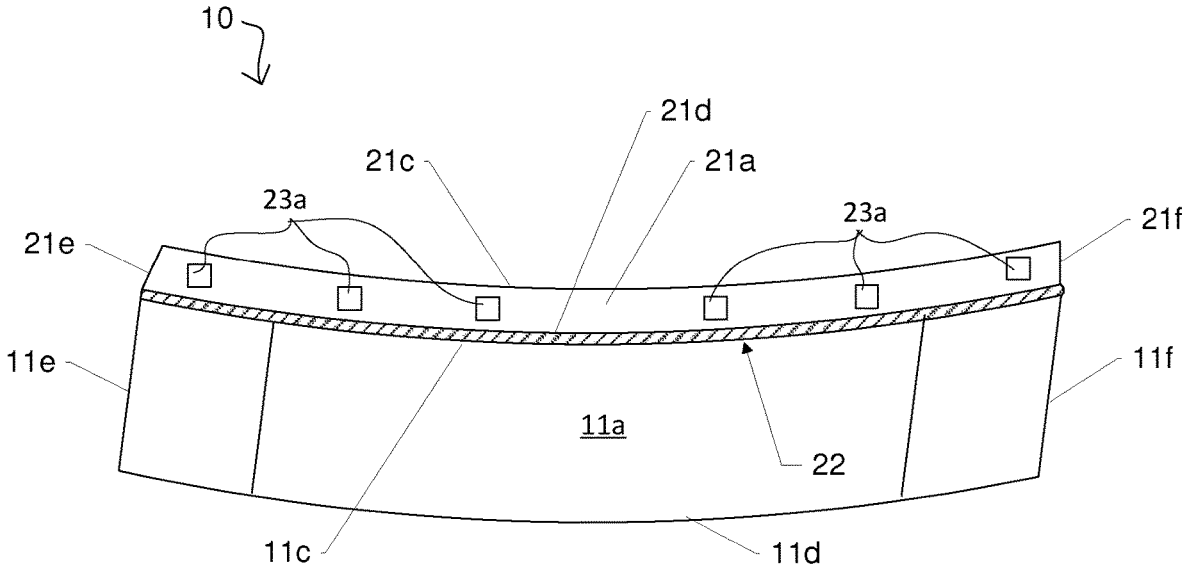
FIG. 2 is a front view of the hat insert device in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described throughout this document, the term "about" "approximately" "substantially" and "generally" shall be used interchangeably to describe a feature, shape or measurement of a component within a tolerance such as, for example, manufacturing tolerances, measurement tolerances or the like.

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "connector" and "gripper" are used interchangeably to describe any number of different elements that work alone or together to repeatedly join two items together in a nonpermanent manner. Several nonlimiting examples of connectors include, but are not limited to, flexible strips of interlocking projections with a slider (i.e., zipper), thread-to-connect, twist-to-connect, and push-to-connect type devices, opposing strips of hook and loop material (e.g., Velcro®), attractively oriented magnetic elements or magnetic and metallic elements, buckles, clips, hooks, snaps and buttons, for example. In some instances, the connector can include a single element such as a hook, which can engage the fabric of the hat body so as to removably secure the insert thereto. In either instance, each connector can be permanently secured to the illustrated component(s) via a permanent sealer such as glue, adhesive tape, or stitching, for example.

FIGS. 1-4 illustrate one embodiment of a hat insert device 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown in the drawings, the insert device 10 can include a main body having a front surface 11*a*, a back surface 11*b*, a top end 11*c*, a bottom end 11*d* and a pair of sides 11*e* and 11*f* that define a generally curved shape that is configured to conform to the shape of a human forehead. In the preferred embodiment, the main body can be constructed from a malleable and waterproof material such as Thermoplastic polyurethane (TPU), for example, however any number of other such materials are also contemplated.

In one embodiment, a liner 12 can be secured along the back surface 11*b* of the main body. Because the front of the liner 12*a* is designed to be in direct contact with the head of the user, the liner will preferably be constructed from a soft and moisture wicking fabric such as bamboo and/or high-tech polyester, for example, that actively draws moisture and odors away from the body. Of course, any number of other materials that are suitable for direct contact with the human body are also contemplated. Several nonlimiting examples include cotton, wool and other such fabrics, for example.

In various embodiments, one or more liners can be provided, and each can include different thicknesses (e.g., defined as the distance between the front surface 12*a* and back surface 12*b* of the liner itself). For example, some liners can be provided that include foam padding 13 along the back surface so as to cause the liner to extend forward from the main body 1 to 2 inches, for example. Such a feature beneficially allows users to wear hats that are slightly larger than their head, without causing the hat to slip, fall or shift while wearing.

In either instance, various embodiments are contemplated wherein each liner can be permanently connected to the main body via adhesives such as glue or resin, for example, whereas other embodiments are contemplated where each liner can be removably connected to the main body. In such an instance, any number of connectors can be positioned between the back surface of the main body and the back surface of the liner or foam insert.

Figure 3A:
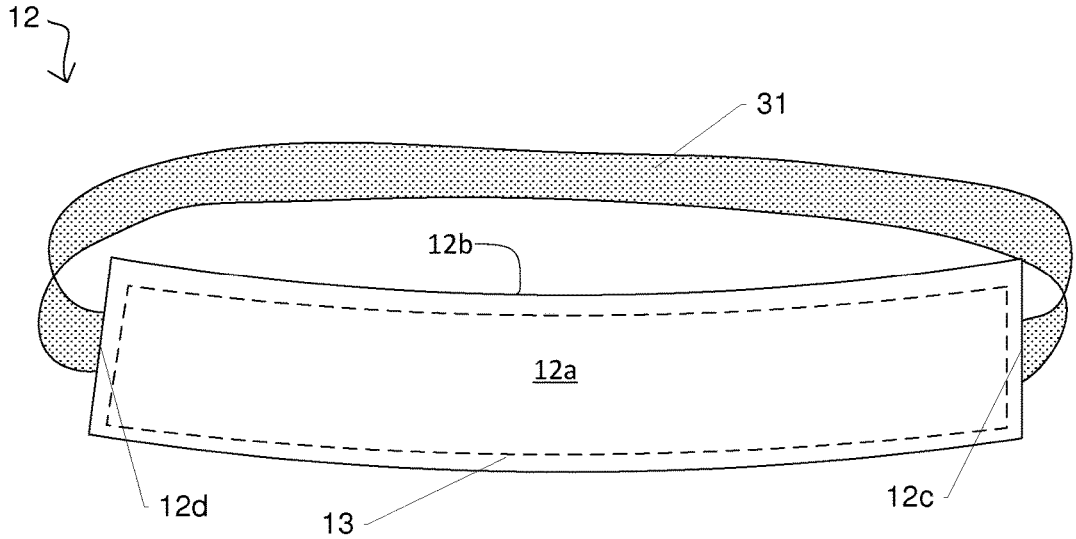
FIG. 3A is perspective view of the liner of the hat insert device, in accordance with one embodiment of the invention.
Figure 3B:
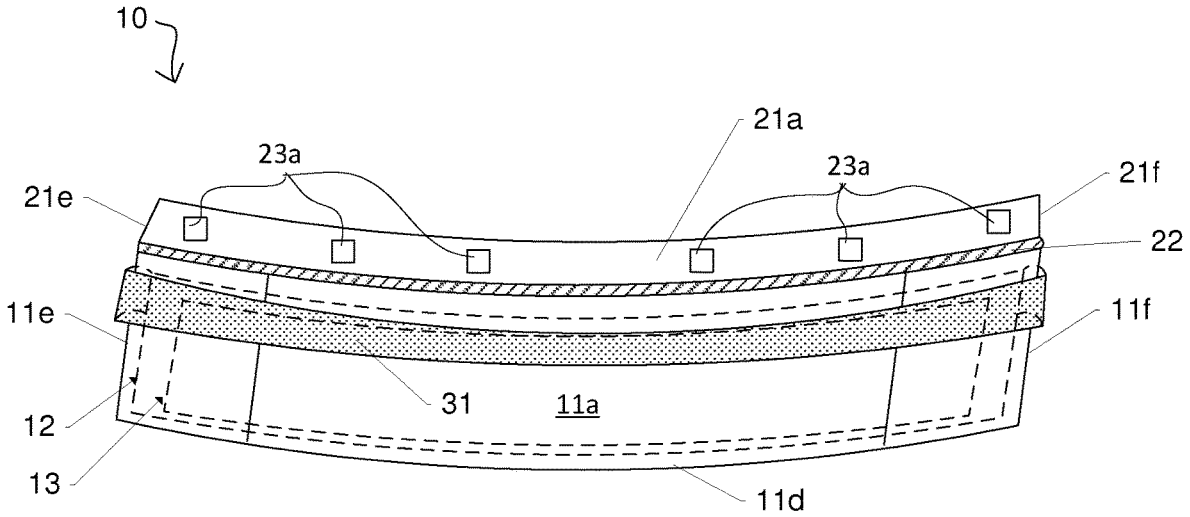
FIG. 3B is perspective view of the liner secured onto the main body of the hat insert device, in accordance with one embodiment of the invention.
Figure 3C:
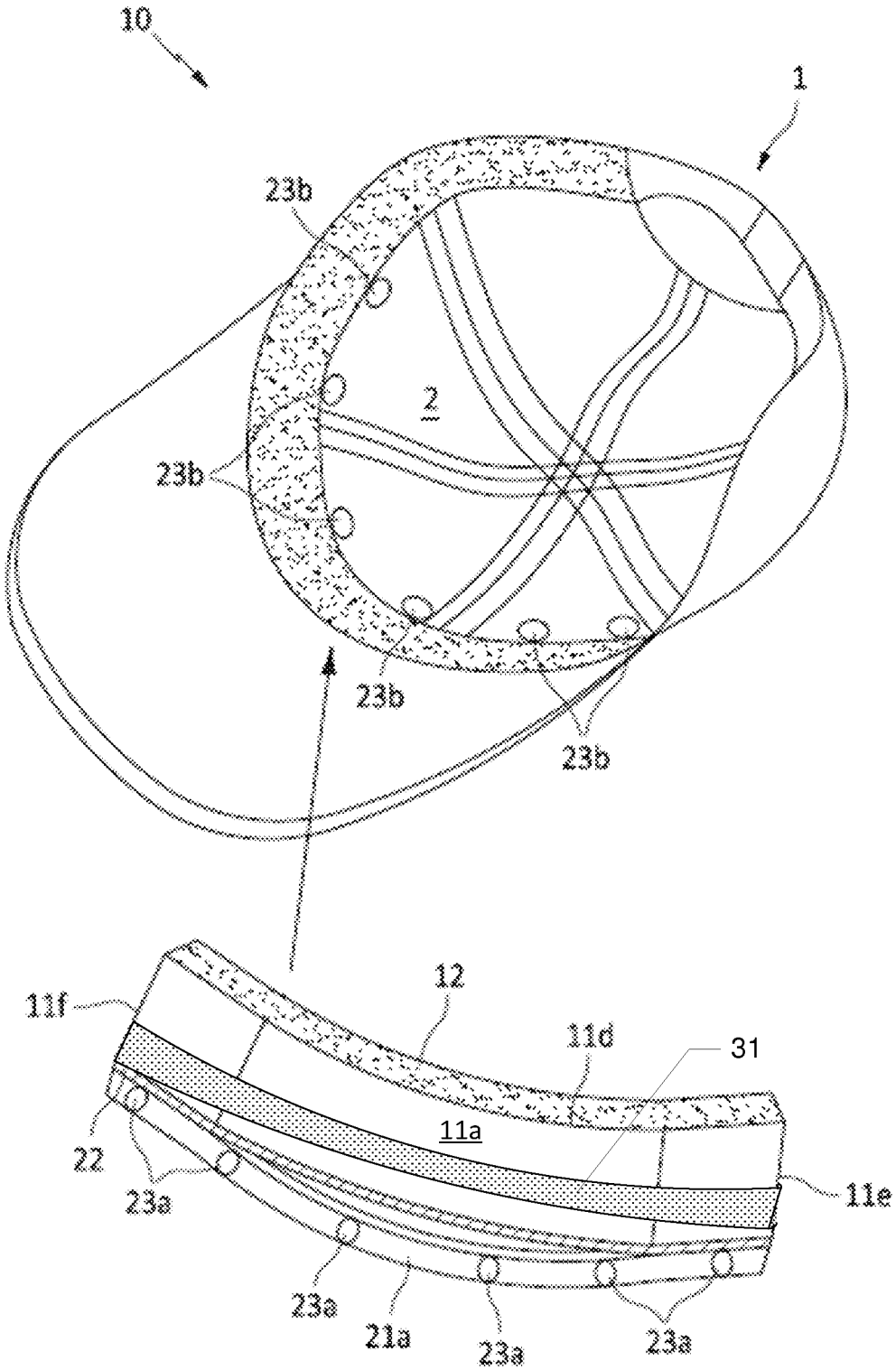
FIG. 3C is a perspective view of the hat insert device in operation, in accordance with one embodiment of the invention.
Figure 4:
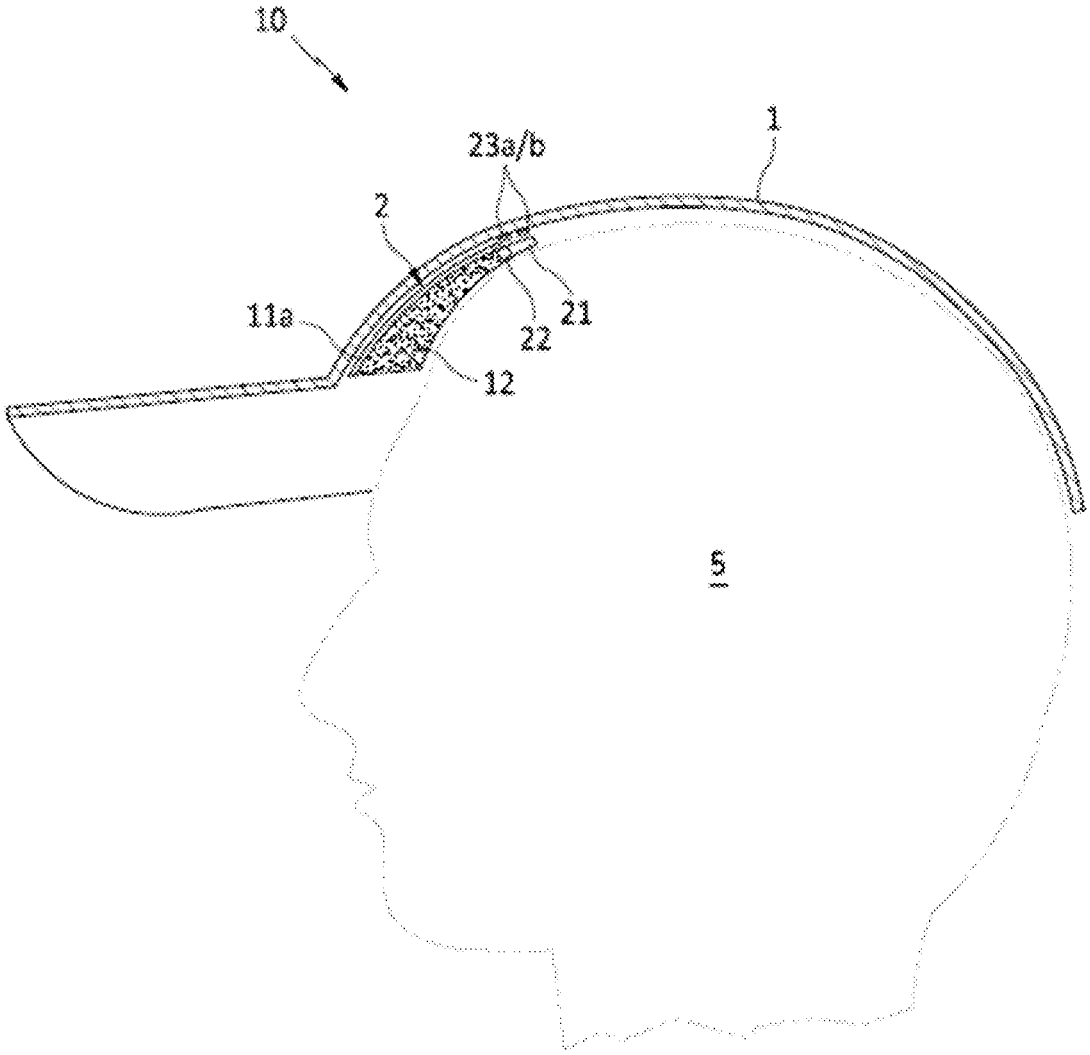
FIG. 4 is a schematic cross section view of the hat insert device in operation, in accordance with one embodiment of the invention.

Moreover, as shown at FIGS. 3A and 3B, some embodiments are contemplated wherein an elastomeric lining strap 31 is provided along the outer edges 12*c* and 12*d* of the liner 12 so as to allow the liner to be stretched across the main body 11 such that the lining strap 31 is located along and against the front surface 11*a* of the main body to maintain the liner with or without the foam insert 13 in place. Such features allow the liner to be quickly and easily removed and laundered between uses. Of course, any number of other means for removing and reinstalling the liner onto the main body are also contemplated.

As shown, an upper lip can extend upward from the top end 11*c* of the main body. The upper lip can also include a front surface 21*a*, a back surface 21*b*, a top end 21*c*, a bottom end 21*d* and a pair of sides 21*e* and 21*f*. As shown by arrow a, the upper lip is designed to be able to bend/flex independently from the main body and can preferably include a hinge 22 that is constructed from a thin channel of material commonly referred to as a living hinge that is constructed from the same material so as to be a unitary component with the main body 11.

Of course, other embodiments are contemplated wherein the hinge 22 includes, comprises or consists of other devices such as discrete plastic hinge(s) so as to hingedly connect and/or removably connect the upper lip to the main body.

In one embodiment, the hat insert device 10 can include a plurality of grippers 23*a* that are disposed along the front surface 21*a* of the upper lip, and another plurality of connectors 23*b* that are to be positioned by a user along the upper portion of the inside panel 2 of a hat 1. In one embodiment, each of the connectors can comprise hook and loop-type elements that are aligned along the respective components so as to allow the main body 11 to be positioned against the majority of the inside panel of the hat (See FIGS. 3C and 4). When so positioned, the liner 12 will be oriented toward the forehead of the user 5 to absorb sweat, and the waterproof qualities of the main body itself will prevent the sweat from making contact with the panel 2.

As described herein, each of the main body and the lip can be constructed to include any number of different shapes, sizes and dimensions. To this end, versions of the device may be constructed to include shapes and dimensions that are suitable for use by children and adults of any size. Moreover, other embodiments are contemplated wherein the device is constructed with a shape or size that is complementary to the inside panel of a specific type of hat (e.g., baseball cap, cowboy hat). To this end, although illustrated and described as a device for making contact with the forehead of a user, other embodiments are contemplated wherein the device may be designed to make contact with any portion of a user's head.

As to a further description of the manner and use of the present invention, the same should be apparent from the above description. Accordingly, no further discussion relating to the manner of usage and operation will be provided.

Although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An insert device, comprising: a main body having a front surface, a back surface and a top surface that define a curved shape; a lip that extends upward from the top surface of the main body; a hinge that secures the lip onto the top surface of the main body; a liner that is positioned along the back surface of the main body; an elastomeric lining strap; wherein the elastomeric lining strap is provided along outer edges of the liner such that the elastomeric lining strap is located along and against the front surface of the main body; and a plurality of connectors that are disposed along a front surface of the lip, wherein each of the plurality of connectors are configured to removably engage additional connectors located along an inside wall of a hat to secure the main body onto the hat, and to orient the liner against a forehead of a user wearing the hat.

2. The device of claim 1, wherein the main body is constructed from a malleable material and is configured to conform to a shape of the user's forehead.

3. The device of claim 2, wherein the main body is constructed from a waterproof material.

4. The device of claim 3, wherein the main body is constructed from thermoplastic polyurethane.

5. The device of claim 1, wherein the liner is constructed from a fabric material.

6. The device of claim 1, wherein the liner is constructed from a moisture wicking material.

7. The device of claim 6, wherein the liner is constructed from bamboo or polyester.

8. The device of claim 1, wherein the liner is permanently secured onto the main body.

9. The device of claim 1, wherein the liner is removably secured onto the main body.

10. The device of claim 1, wherein the lip is configured to bend and fold independent of the main body.

11. The device of claim 1, wherein the hinge comprises a living hinge.

12. The device of claim 1, wherein the plurality of connectors and additional connectors each comprise strips of hook and loop material.

13. The device of claim 1, further comprising:

padding that is positioned along a back surface of the liner.

14. The device of claim 13, wherein the padding is constructed from foam.

15. The device of claim 13, wherein the liner and padding are removably secured onto the main body by the elastomeric lining strap.

16. The device of claim 1, wherein the liner is removably secured onto the main body by the elastomeric lining strap.

* * * * *